US005797472A

United States Patent [19]

Kamani et al.

[11] Patent Number: 5,797,472

[45] Date of Patent: Aug. 25, 1998

[54] REACTIVE GOVERNOR

[75] Inventors: Sanjay Kamani, Unionville; John K. Salmon, deceased, late of South Windsor, both of Conn., by Lucy Mary Salmon, executor

[73] Assignee: Otis Elevator Company, Farmington, Conn.

[21] Appl. No.: 592,782

[22] Filed: Jan. 26, 1996

[51] Int. Cl.[6] ..... B66B 5/16

[52] U.S. Cl. ..... 187/373; 188/188

[58] Field of Search ..... 187/373, 350, 187/359, 351; 188/161, 171, 188, 189

[56] References Cited

U.S. PATENT DOCUMENTS

| | | | |
|---|---|---|---|
| 1,581,459 | 4/1926 | Lindquist | 187/80 |
| 1,738,215 | 12/1929 | Thurston et al. | 187/59 |
| 1,948,746 | 2/1934 | Dunlop | 187/89 |
| 3,441,107 | 4/1969 | Thorne et al. | 187/90 |
| 3,872,949 | 3/1975 | Snyder | 187/80 |
| 4,133,413 | 1/1979 | Watanabe | 187/29 R |
| 4,263,988 | 4/1981 | Inaba et al. | 187/29 R |
| 5,154,261 | 10/1992 | Tanaka et al. | 188/171 |
| 5,301,773 | 4/1994 | Jamieson et al. | 187/88 |
| 5,366,044 | 11/1994 | Jamieson et al. | 187/359 |

FOREIGN PATENT DOCUMENTS

| | | | |
|---|---|---|---|
| 0498597 | 8/1992 | European Pat. Off. | 187/108 |
| 5751040 | 3/1982 | Japan . | |

*Primary Examiner*—Kenneth Noland

[57] ABSTRACT

A governor for a moving device, such as an elevator, includes a primary assembly that generates a magnetic field and a secondary assembly extending through the generated magnetic field. The assemblies define a rotor and a stator that rotate at a relative speed that is proportional to the speed of the moving device. The stator is biased into a stationary position. If the relative rotational speed exceeds a predetermined limit, the bias on the stator is overcome by the interaction of the secondary assembly with the magnetic field. Movement of the stator away from the stationary position actuates an apparatus to prevent an overspeed condition of the moving device.

26 Claims, 5 Drawing Sheets

REACTIVE GOVERNOR

TECHNICAL FIELD

The present invention relates to governors for preventing overspeed conditions of moving devices.

BACKGROUND OF THE INVENTION

A governor is a device on a machine used to control an operational parameter of the machine. In many applications the operational parameter is speed, such as the rotational speed of an engine or the traveling speed of an elevator car. In a typical application, the speed of the machine is monitored, either electronically or mechanically. If an overspeed condition occurs, the governor triggers a sequence of events that attempt to reduce the speed of the machine to within an acceptable range.

There are specific requirements on governors used in elevator applications. First, the governor must not require a supply of power external to the elevator itself. This requirement is the result of the governor having to perform its function, i.e., controlling the traveling speed of the elevator, even when the external source of power for the elevator has become disabled. The second requirement is that the elevator governor must be calibrated at installation and be capable of confirmation of its calibration and performance throughout the life of the elevator.

The most common type of elevator governor is the 'flyweight' governor. In this type of governor, eccentric masses rotate about an axis at a speed that is proportional to the traveling speed of the elevator. Springs are used to retain the masses against the centrifugal force, which urge the masses to move outward. If the speed of the masses exceeds a first threshold, the masses move radially outward a distance sufficient to actuate a switch. Actuating the switch removes power to the drive of the elevator and thereby removes the driving torque on the elevator car. If the speed of the masses exceeds a second threshold, the safeties on the elevator car are actuated to grip the guide rails and bring the car to a stop.

Flyweight governors have proved to be very effective, as evidenced by their universal application. One of the drawbacks, however, is the need to manually calibrate and recheck the operation of the flyweight governors. The use of rotating, eccentric masses connected by complex linkages having multiple pivot points introduces the need for proper alignment and lubrication. In addition, the springs used to counter the centrifugal forces are being cyclically loaded and unloaded, which results in a device that is subject to wear.

The above art notwithstanding, scientists and engineers under the direction of Applicants' Assignee are working to develop effective, reliable and easily maintainable governors for moving devices, such as elevators.

DISCLOSURE OF THE INVENTION

According to the present invention, a governor includes a primary assembly that generates a magnetic field and a secondary assembly extending through the magnetic field. One of either the primary or secondary assemblies is a stator biased into a first position. The other of the primary or secondary assemblies is a rotor that is rotatable at a rotational speed proportional to the speed of the moving device. If the rotational speed of the rotor exceeds a predetermined speed the stator is moved away from the first position.

Relative rotation of the primary and secondary assemblies induces an electrical current in the secondary and a corresponding magnetic field about the secondary assembly. By biasing one of the assemblies into a stationary position, the interaction of the magnetic field of the primary and the induced magnetic field of the secondary generates a torque on the biased assembly. This torque is proportional to the relative speed of rotation.

In a particular application, one of the assemblies is configured to rotate at a speed proportional to the speed of the moving device. By preselecting the biasing force to be equal to a specific torque generated at a threshold speed, movement of the stator away from first position can be used to actuate an apparatus to prevent an overspeed condition from occurring.

In a particular embodiment, the governor is used to prevent overspeed conditions of an elevator. In this embodiment, the primary assembly includes a permanent magnet that generates the magnetic field and the secondary assembly includes a frame having a plurality of conducting elements that extend through the magnetic field. The primary assembly is mass balanced such that it is biased into a first position. The secondary assembly is rotatable and includes a sheave engaged with a governor rope fixed to the elevator. As the elevator moves through the hoistway, the secondary assembly rotates about the primary assembly. If the rotational speed of the secondary assembly exceeds a predetermined speed the primary assembly is moved away from the first position and a mechanism is activated to reduce the traveling speed of the elevator. In this particular embodiment, the primary assembly is a stator and the secondary assembly is a rotor. In an alternate embodiment, the primary assembly is a rotor and the secondary assembly is a stator.

This particular application has the advantage of providing an elevator governor that does not require external power. As a result, the governor will operate regardless of the condition of the power supply to the elevator. In addition, the moving parts associated with the governor of the invention are minimal and therefore the governor requires minimal adjustment and maintenance once installed. As a further advantage, the elevator governor is easily configurable for various elevator applications by simply changing the mass balance of the stator. If the governor is to be used with a high speed elevator, mass may be added to the stator to increase the threshold at which the interaction between the primary assembly and the secondary assembly will cause the stator to move away from the first position.

In a further particular embodiment of the elevator governor, the stator includes a switch to remove drive torque from the elevator and a mechanism to generate a force on the governor rope opposite to the direction of travel such that a safety brake apparatus on the elevator is engaged. The switch is activated by the initial movement of the stator away from the first position. The mechanism is activated by further movement of the stator. In addition, the stator includes means to provide additional bias once the stator is initially moved away from the first position. In this configuration, the overspeed protection is a two step process. At a first threshold speed, the stator is moved to open the switch and remove the driving torque from the elevator. If the elevator continues to increase in speed to a second threshold speed, then the torque on the stator caused by the rotor will overcome the additional biasing means. At this point the stator will rotate until the safety triggering mechanism is engaged.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
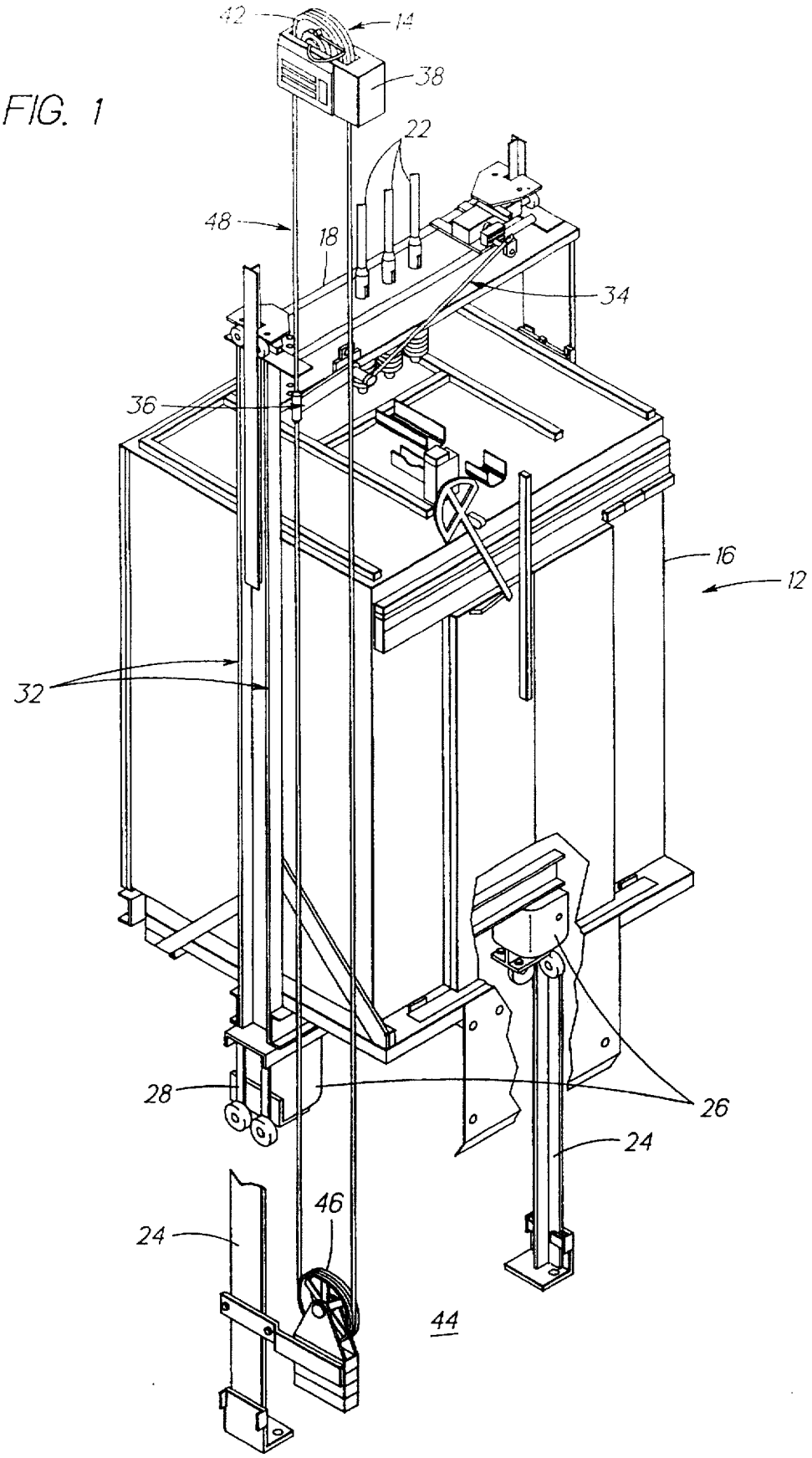
FIG. 1 is an illustration of an elevator, elevator hoistway equipment and governor.
Figure 2:
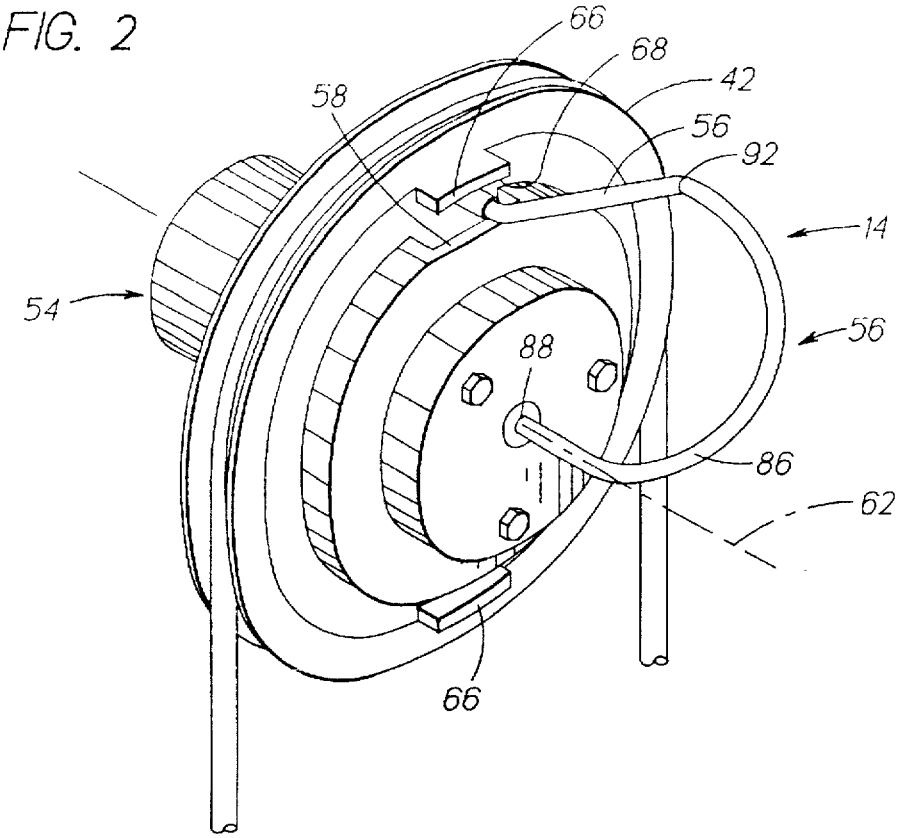
FIG. 2 is a perspective view of the governor, with the frame removed for clarity.
Figure 3:
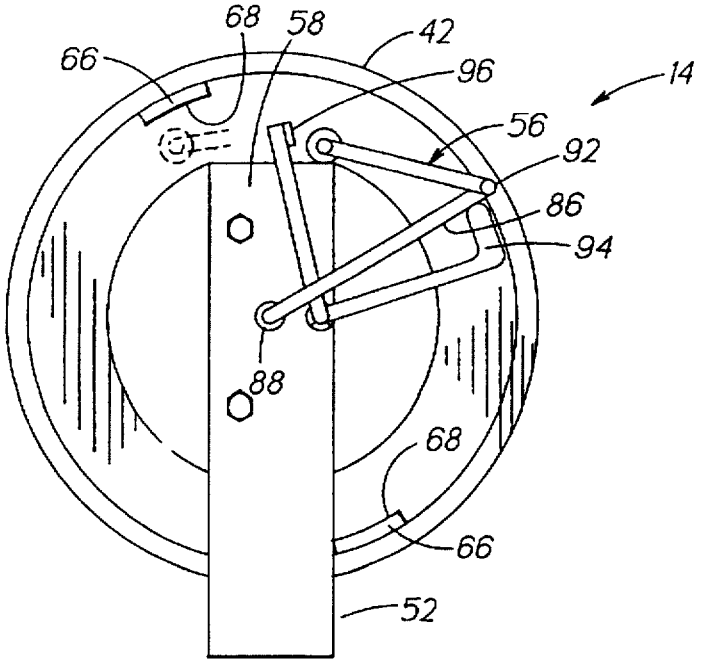
FIG. 3 is a front view of the governor.
Figure 4:
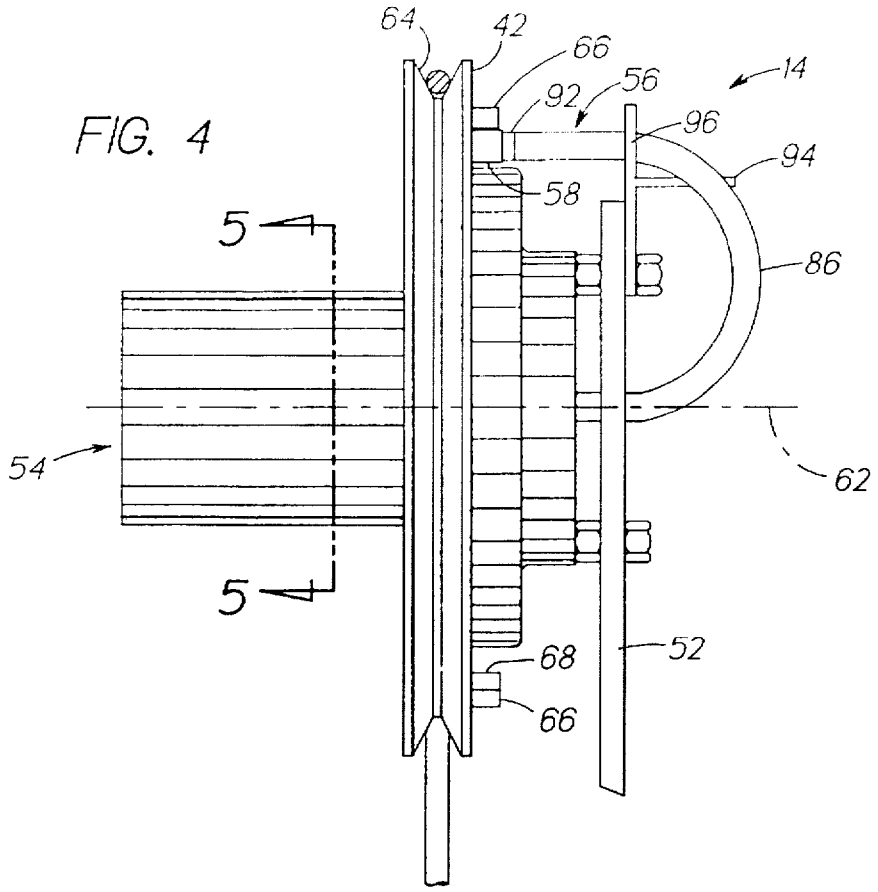
FIG. 4 is a side view of the governor.

Illustrated in FIG. 1 is an elevator 12 and governor assembly 14. As is well known, the elevator 12 includes a car 16, a car frame 18 supporting the car 16 and suspended from a plurality of ropes 22, and a pair of guide rails 24 on opposite sides of the car 16 and engaged with the car frame 18 to guide the motion of the car frame 18. The car frame 18 includes a safety mechanism 26 to stop the motion of the car frame 18 in the event of an overspeed condition. The safety mechanism 26 mechanism includes a wedge type safety 28 engageable with each guide rail, a set of lift rods 32 for each safety 26, a linkage 34 connecting the sets of lift rods 32 for simultaneous actuation, and a lever 36 engaged with the governor assembly 14.

The governor assembly 14 includes a governor 38 having a sheave 42, a tension assembly 44 having a sheave 46, and a governor rope 48 extending between the governor sheave 42 and the tension sheave 46 and fixedly connected to the lever 36. The tension assembly 44 ensures that there is sufficient tension in the governor rope 48 to prevent excessive slipping between the governor rope 48 and the governor sheave 42. In the event of an overspeed condition of the elevator 12, the governor 38 will generate a force on the rope 22 opposite to the direction of travel. This force will actuate the lever 36 and thereby the safety mechanism 26 to eliminate the overspeed condition.

FIGS. 2–5 illustrate the governor 38. The governor 38 includes a frame 52, the sheave 42, a magnetic assembly 54, and means 56 for stopping rotation of the sheave 42. The frame 52 supports and maintains the proper orientation of the governor 38 and includes a roller surface 58 along one upper edge. The sheave 42 is rotatable about an axis 62 and includes a groove 64 for the rope 22 and a pair of stops 66. The stops 66 extend laterally outward from the sheave and have a surface 68 that extends progressively radially inward.

The magnetic assembly 54 includes a primary assembly 72 and a secondary assembly 74. As shown more clearly in FIG. 5, the primary assembly 72 is a permanent magnet 76 disposed about the axis 62 of the governor 38. The permanent magnet 76 includes a plurality of magnetic poles 78, labeled "N" and "S" in the drawing, that generate a magnetic field about the permanent magnet 76. The primary assembly 72 is free to rotate but is rotationally biased into a stationary position. Suggested types of permanent magnets include an arrangement of Alnico magnets or Neodymium/Iron/Boron magnets, commercially available from Crucible Magnetics in Elizabethtown, Ky., although other types of magnets may be applicable.

The secondary assembly extends about and is radially spaced from the primary assembly. The secondary assembly includes a ferromagnetic frame 82 and a plurality of conductors 84 disposed on the frame 52 to form a conventional squirrel cage. The plurality of conductors 84 are radially positioned to extend through the magnetic field generated by the primary assembly. The secondary assembly 14 is fixed to the sheave for rotation with the sheave 46. It is suggested that a copper-nickel compound having approximately six percent nickel be used to form the conductors 84 because of its minimal variation in electrical resistance with temperature.

As a result of the primary assembly 72 being biased into a stationary position and the secondary assembly 74 rotating with the sheave 42, the primary assembly 72 defines a stator and the secondary assembly 74 defines a rotor.

The stopping means 56 includes an arm 86 extending out from the primary assembly 72, through an aperture 88 in the frame 52 and shaped such that the distal end 92 of the arm 86 is proximate to the sheave 42. The arm 86 is rotationally fixed to the primary assembly 72 such that it is free to rotate but is rotationally biased into the stationary position. The arm 86 is supported in the stationary position by a support 94 extending from the frame 52 and the rotational motion of the arm 86 is limited by a stop 96 also extending from the frame 52.

As illustrated in FIGS. 1–5, the rotational bias is the result of the mass unbalance of the primary assembly 72 caused by the attachment of the arm 86. In some applications, this may arrangement may not produce a sufficient biasing force and additional mass may be required to be added to the arm 86. As another alternative, a spring or other resilient means may be attached to the arm 86 or primary assembly 72 to provide the necessary biasing force.

The stopping means 56 further includes a roller 98 and a hinged extension 102. The roller 98 is disposed on one end of the extension 102 in a manner permitting rotation of the roller 98 and is supported by the roller surface 58 of the frame 52. The other end of the extension 102 is fixed in a hinged relationship to the arm 86. Rotation of the primary assembly 72 and arm 86 cause the hinged extension 102 to move the roller 98 on the roller surface 58. In the stationary position, the roller 98 is positioned as shown in the solid line portion of FIG. 3. Upon sufficient rotation of the primary assembly 72 and arm 86 such that the arm 86 engages the stop 96, the roller 98 is positioned as shown by the dotted line portion of FIG. 3. In this latter position, the roller 98 will interfere with the motion of the surface 68 of the stop 96 to prevent rotation of the sheave 42.

During operation, the elevator 12 car frame 18 travels up and down through the hoistway. As the car frame 18 moves, the governor 38 rope attached to the car frame 18 also moves and causes the governor sheave 42, and thereby the secondary assembly 74, to rotate. Rotation of the secondary assembly 74 causes the conductors 84 and frame 52 to move through the magnetic field generated by the stationary permanent magnet 76. This motion will generate a flow of electrical current through the conductors 84, which will in turn generate a magnetic field about the secondary assembly 74. This induced magnetic field will rotate with the secondary assembly 74. The interaction of this rotating field about the secondary assembly 74 and the stationary field about the primary will cause a torque on the primary assembly 72 proportional to the relative speed of rotation.

At normal downward operating speeds of the elevator 12, the torque generated by the relative motion between the primary and secondary assemblies will not be sufficient to overcome the bias holding the primary assembly 72 into the stationary position. If the car frame 18 is traveling in the upward direction, the torque generated will amplify the bias on the primary assembly 72. If the car frame 18 begins to move in a downward direction at an excessive speed, however, the torque will exceed the bias on the primary assembly 72 and cause the primary assembly 72 to rotate. This rotation causes the arm 86 to rotate and the roller 98 to move across the roller surface 58 until the arm 86 engages the stop 96 and the roller 98 reaches the position shown by the dotted line in FIG. 3. In this position, as the sheave 42 continues to rotate one of the stops 66 will engage the roller 98 and stop the rotation of the sheave 42. The sudden stopping of the sheave 42 rotation will generate an upward force on the governor rope 48 sufficient to lift the lever 36 and operate the safeties, thereby slowing the speed of the car frame 18. Once the car frame 18 is under control, the roller 98 may be disengaged from the stop 96 by reversing the travel of car frame 18. The bias will cause the arm 86 and primary assembly 72 to move back into the stationary position.

Figure 5:
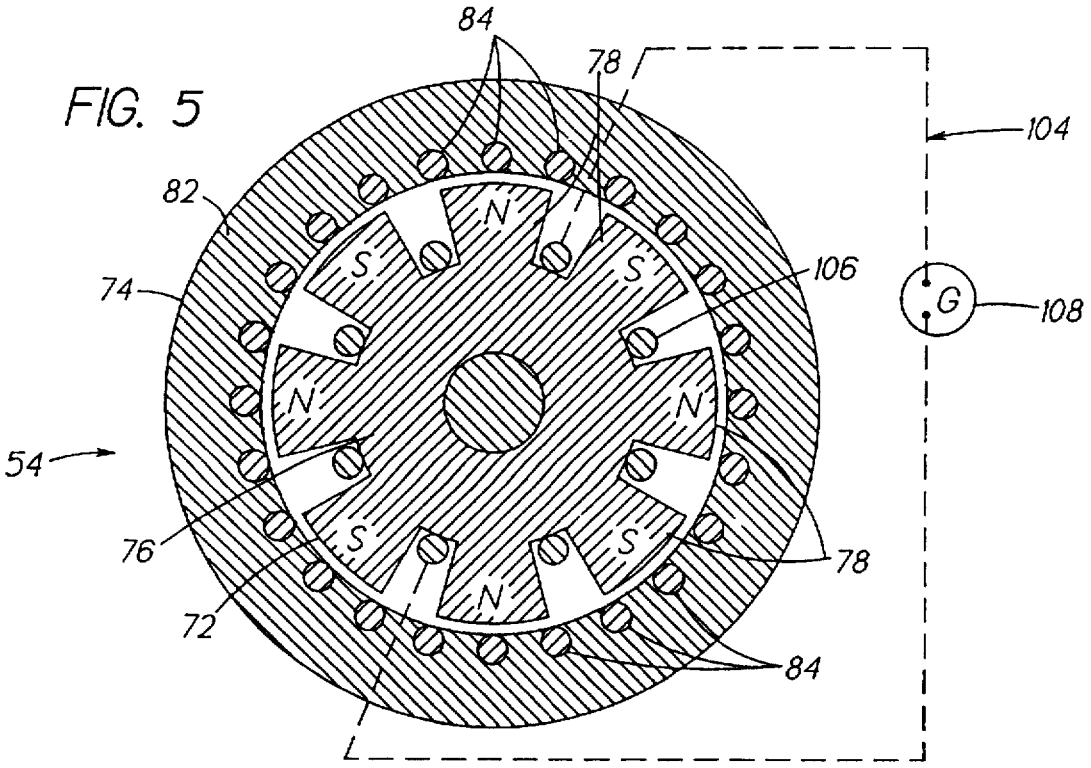
FIG. 5 is a sectional view of the governor taken along line 5—5 of FIG. 4.

Although permanent magnets are very dependable, over time and usage the permanent magnet 76 may begin to degrade and effect the performance of the governor 38. To monitor the functioning of the governor 38, a health monitoring system 104 as shown in FIG. 5 may be useful. The health monitoring system 104 includes a conductor 106 that is wound around the permanent magnet 76 and positioned such that it is acted upon by the magnetic field generated by the secondary assembly 74. The interaction between the conductor 106 and the moving magnetic field generated by the secondary assembly 74 will generate a flow of electrical current through the conductor 106. This flow of current is directly proportional to the strength of the magnetic field generated by the secondary assembly 74, and therefore to the magnetic field generated by the permanent magnet 76. This flow of current through the conductor 106 may be monitored by a monitoring system 108 during the operation of the elevator 12 and will continuously provide feedback on the strength of the permanent magnet 76 and the functioning of the governor 38. This output may be directed to a remote monitoring system (not shown) for the elevator 12 to trigger maintenance on the governor 38 as needed.

As an alternative to the health monitoring system described above, there are other means to prevent operation of the elevator system in the event that the permanent magnet has significantly degraded. One such alternative (not shown) is a switch having an element that is responsive to the magnetic field generated by the permanent magnet, similar to a solenoid type switch. As long as the permanent magnet generates a magnetic field of sufficient magnitude, the switch element is held in a closed position and permits operation of the elevator system. If the magnetic field is insufficient, indicating that the permanent magnet has degraded, the switch element will be urged by an external force, such as a spring, into an open position and prevents operation of the elevator system.

Although the embodiment shown in FIGS. 1–5 illustrates a primary assembly 72 acting as the stator and a secondary assembly 74 acting as the rotor, it should be apparent that it is relative motion between the primary and secondary assemblies that makes the governor 38 functional. Therefore, the primary assembly 72 may be the rotor and the secondary assembly 74 may be the stator, as desired.

Figure 6:
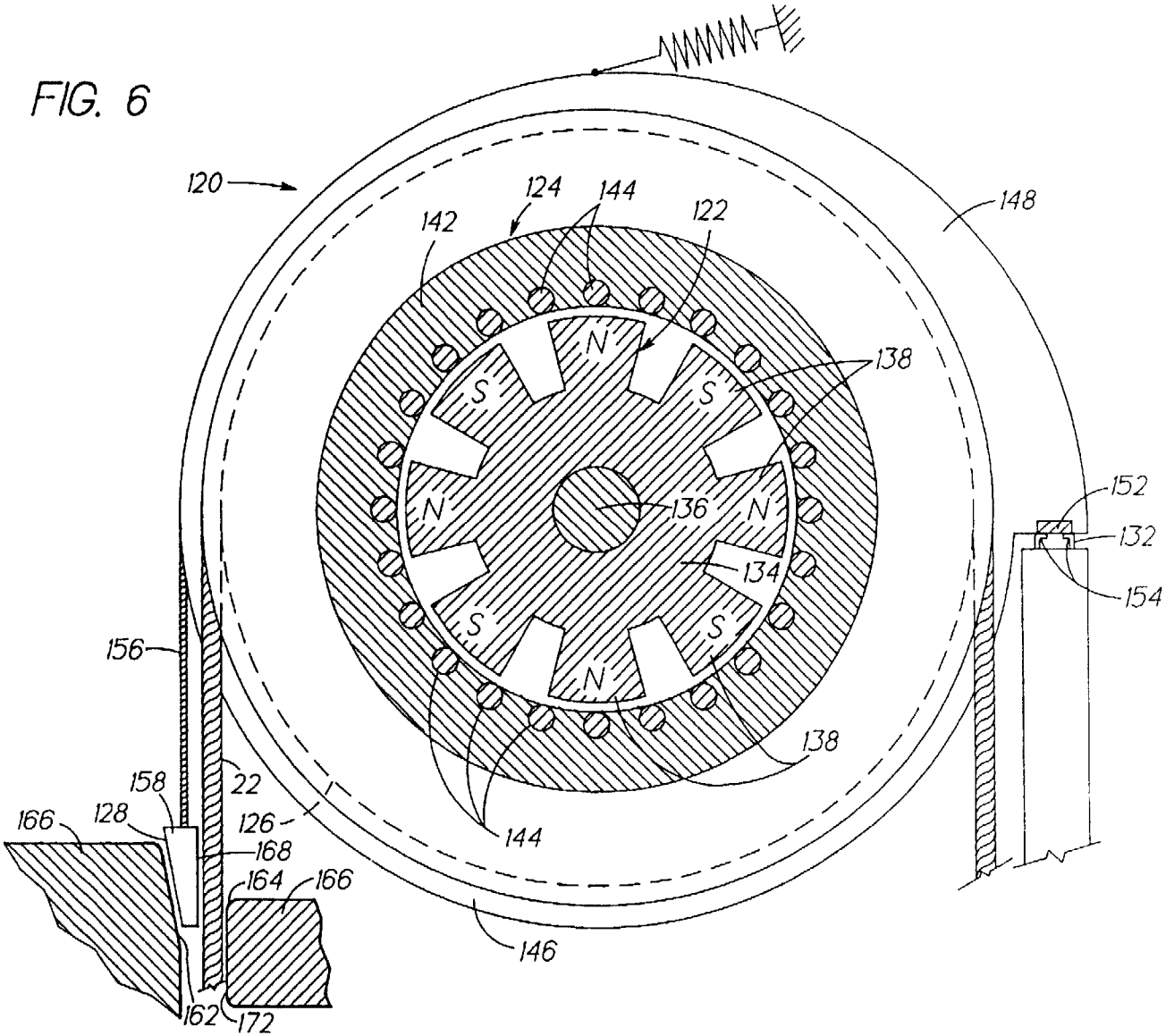
FIG. 6 is a sectional view of an alternate embodiment of the governor.

An alternate embodiment exemplifying this relationship is illustrated in FIG. 6. In this embodiment, a governor 120 includes a primary assembly 122, a secondary assembly 124, a sheave 126, a wedge clamp 128, and a switch 132. The primary assembly 122 includes a permanent magnet 134 disposed about an axis 136 of the governor 120 and having a plurality of magnetic poles 138 spaced circumferentially. The primary assembly 122 is fixed to the sheave 126 for common rotation therewith. The secondary assembly 124 is radially spaced from the primary assembly 122 and includes a ferromagnetic frame 142 and a plurality of conductors 144 positioned to extend through the magnetic field generated by the permanent magnet 134.

The secondary assembly 124 further includes a plate 146 extending radially outward from the frame 52. The plate 146 has an outer flange 148 that increases gradually in radial dimension from one side of the governor 120 to the other. The radially disproportionate flange 148 provides a mass unbalance that biases the secondary assembly 124 into a stationary position. Attached to an edge of the flange 148 is a shorting bar 152 formed of electrically conductive material.

Immediately adjacent to, and positioned for contact with, the shorting bar 152 is a pair of electrical contacts 154 that form part of the electrical switch 132. With the secondary assembly 124 in the stationary position, the shorting bar 152 is in contact with both of the contacts such that the switch 132 is closed. The switch 132 is integrated into the circuitry controlling the operation of the drive means (not shown) for the elevator. If the secondary assembly 124 is moved away from the stationary position, the shorting bar 152 is separated from the contacts 154 and the switch 132 is opened.

The wedge clamp 128 extends from the plate 146 by a bar 156 formed from spring steel. The wedge clamp 128 includes a graduated surface 158 that is proximate to a complementary surface 162 disposed on an aperture 164 of the governor frame 166 that accommodates the governor rope 48. Opposite the graduated surface 158, the wedge clamp 128 has a second surface 168 that is proximate to the governor rope 48. The governor frame 166 also includes a second surface 172 proximate to the governor rope 48 and opposite to the wedge clamp 128 and complementary surface 162. With the secondary assembly 124 in the stationary position, the wedge clamp 128 is held proximate to, but not in contact with, the governor rope 48 and complementary surface 162. Upon rotation of the secondary assembly 124, the wedge clamp 128 is inserted into the aperture 164. Contact between the wedge clamp 128 and the complementary surface 162 forces the wedge clamp 128 against the governor rope 48 and the governor rope 48 against the opposing surface of the aperture 164. Friction between the governor rope 48 and wedge clamp 128 then pulls the wedge clamp 128 further into the aperture 164. As the wedge clamp 128 is pulled into the aperture 164, a squeezing force is exerted onto the governor rope 48. This force provides the upward force on the rope 22 to operate the lever 36, and thereby the safeties.

During operation of the embodiment shown in FIG. 6, the elevator car frame travels up and down through the hoistway. As the car frame moves, the governor rope 48 attached to the car frame also moves and causes the governor sheave 42, and thereby the primary assembly 122, to rotate. Rotation of the primary assembly 122 causes the permanent magnet 134, and the magnetic field generated by the permanent magnet 134, to rotate. This motion will generate a flow of electrical current through the conductors 144 of the secondary assembly which will in turn generate a magnetic field about the secondary assembly 124. This magnetic field will interact with the rotating magnetic field of the primary assembly 122. The interaction will cause a torque on the secondary assembly 124 proportional to the relative speed of rotation.

At normal downward operating speeds of the elevator, the torque generated by the relative motion between the primary and secondary assemblies will not be sufficient to overcome the bias holding the secondary assembly 124 into the stationary position. If the car frame is traveling in the upward direction, the torque generated will amplify the bias on the primary assembly 122. If the car frame begins to move in a downward direction at an excessive speed, however, the torque will exceed the bias on the secondary assembly 124 and cause the secondary assembly 124 to rotate.

The initial motion of the secondary assembly 124 will cause the shorting bar 152 to separate from the electrical contacts 154. The separation will open the switch 132 and thereby remove power from the drive machine. If the elevator is overspeeding as a result of the drive machine driving the car frame at excessive speed, removing the power from the drive machine will bring the elevator speed within an acceptable range.

If the elevator continues to travel at excessive speed even after removal of power to the drive machine, the secondary assembly 124 will continue to rotate about the axis 136 62. This additional rotation will insert the wedge clamp 128 into the aperture 164 until the surfaces of the clamp engage the rope 22 and surface of the aperture 164. The wedging action of the wedge clamp 128 will generate an upward force on the governor rope 48 sufficient to lift the lever 36 and operate the safeties, thereby slowing the speed of the car frame. Once the car frame is under control, the wedge clamp 128 may be disengaged from the rope 22 by reversing the travel of car frame. The bias will cause the secondary assembly 124 to move back into the stationary position.

To ensure that the safeties are not employed at an excessive frequency, a spring 174 may be used to increase the bias on the secondary assembly 124 after the initial movement has opened the switch 132. The spring 174, shown schematically in FIG. 6, provides additional resistance to further motion of the secondary assembly 124 away from the stationary position, thus providing the step of removing power from the drive machine an opportunity to slow the traveling speed of the elevator. If the elevator continues to gain speed, the torque between the rotating primary assembly 122 and the biased secondary assembly 124 will increase proportionally until the wedge clamp 128 is inserted into the aperture 164.

In addition to relative speed, the operation of the governors illustrated in the embodiments of FIGS. 1–6 are dependent upon the level of magnetic flux generated by the primary assembly 122 and the resistance of the conductors 144. The torque generated between the primary assembly 122 and the secondary assembly 124 is proportional to the speed and flux, and inversely proportional to the resistance of the conductors 144. The flux generated and the resistance of the conductors 144, however, are dependent upon temperature: the flux generated decreases with increasing temperature and the resistance increases with increasing temperature. For governors used in environments having a broad range of temperatures, such as an elevator machine room, this dependency on temperature may introduce undesirable variability in the operation of the governor 120.

Figure 7:
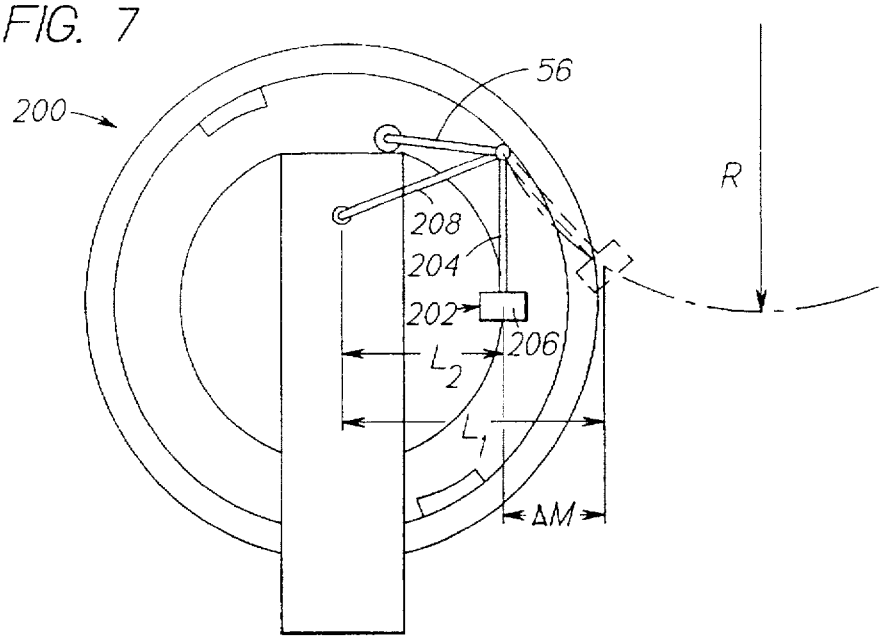
FIG. 7 is a front view of a governor having means to compensate the governor for temperature fluctuations.
Figure 8:
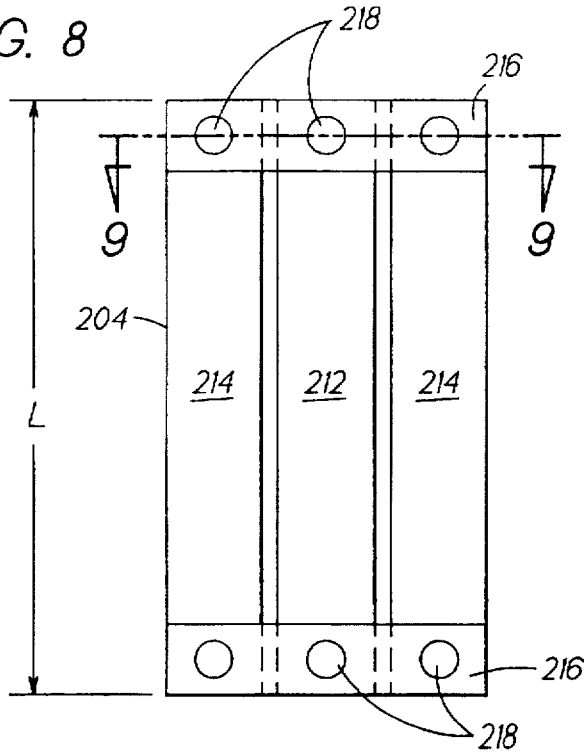
FIG. 8 is a view of the temperature compensating means taken along line 8—8 of FIG. 7.

FIG. 7 illustrates a governor 200 having means 202 to compensate the operation of the governor 200 for temperature fluctuations. The temperature compensation means 202 includes a bimetallic link 204 and a mass 206 attached to the link 204. The link 204 is fixed at one end to the arm 208 and retains the mass 206 at the opposite end. The link 204 is formed from a single strip 212 of a first material and a pair of strips 214 of a second material, arranged side by side as shown in FIG. 8. The ends of the strips are clamped together by two pairs of clamping plates 216 fixed by a plurality of fasteners 218. Shims 222 are used to offset the strips such that the different radii of curvature may be accommodated.

The link 204 is formed such that at the lowest temperature within the expected range of temperatures for the governor 200, the link 204 is curved as shown by the dotted lines in FIG. 7. The curvature is the result of the rates of thermal expansion of the materials used for the strips. At higher temperatures, the link 204 becomes less curved, i.e., the radii of curvature for the strips increases. As a result of the temperature dependent radius of curvature, the moment arm 208 defined by the arm 208, the link 204 and the mass 206 also varies with temperature. At minimum temperature, the moment arm 208 has a length of L1. At maximum temperature, the moment arm 208 has a length of L2, wherein L2 is less than L1. The shorter moment arm 208 balances the lower torques generated at those temperatures, and thereby compensates the governor 200 for the temperature variation of the environment.

There are two parameters in the operation of the governor that may lead to variability in the performance of the governor and therefore may require accommodation. The first is the long term degradation of the permanent magnet. For permanent magnets of the Alnico type, this degradation is estimated to be approximately 1% over a 25 year period.

The second parameter is the variation in operation of the governor as a function of temperature. This variation results primarily from the dependence on temperature of resistance of the conductors. Assuming the conductors are formed from a conventional 6% Nickel/Copper material, it may be estimated that this variation in resistance is approximately (0.08%)/degree Celsius. The magnetic flux generated by the permanent magnet, however, also will vary slightly with temperature. For permanent magnets of the Alnico type, this may be estimated to be approximately (0.02%)/degree Celsius.

For elevator applications, the ambient temperature in the machine room may fluctuate from −20 degrees Celsius to +60 degrees Celsius, for a total temperature range of 80 degrees Celsius. Using the conductors and permanent magnets suggested above, the total amount of temperature related variation in the torque generated at fill speed of the elevator may be estimated as follows:

$$\text{maximum torque variation}=[(1+(\Delta t)(\alpha))^2]*[(1+(\Delta t)(\beta))]+[(1+(\gamma))^2]$$

where $\Delta t$=temperature range $\alpha$=magnetic flux variation as a function of temperature $\beta$=conductor resistance variation as a function of temperature $\gamma$=maximum degradation of the permanent magnet over lifespan Using the values presented above, this calculation becomes $$[(1+(80)(0.0002))^2]*[(1+(80)(0.0008))]+[(1+(0.01))^2]=1.12$$

which equates to a maximum variation in torque generated at fill speed of about 12%. This 12% variation in torque may be compensated for by an equivalent variation (ΔM) in the length of the effective moment arm 208 (ΔM=L1–L2). First, assume the minimum effective length of the arm 208 is 101.6 mm. Therefore, the maximum effective length is 113.8 mm (101.6*1.12). The necessary effect is to move the mass 12.2 mm relative to the pivot point of the arm 208 as the temperature varies over the determined range. Further, assuming the link 204 has a length of 152.4 mm, and assuming the single strip is formed from spring steel and the pair of strips are formed from phosphor bronze, and are 12.7 mm thick, the necessary offset may be calculated from the difference in radius of curvature for the strips.

The calculation, using the variables as shown in FIG. 7, begins by solving the following equations simultaneously.

$$\Delta M=R*(1-\cos\Theta);\text{ and}$$

$$L=R*\sin\Theta$$

Solving for Θ in a conventional manner, using L=152.4 mm and ΔM=12.2 mm, results in Θ=9.15 degrees and R=958.6 mm. The centerline offset may then be calculated from the following equation:

$$\text{offset}=(\delta/L)*R$$

where δ is the strain on the strips. For the suggested materials of spring steel (coefficient of expansion of 0.0000108/degree C) and phosphor bronze (coefficient of expansion of 0.000018/degree C), the resulting thermal expansion differential is 0.0000072/degree C. For a temperature range of Δt=80 degrees Celsius and a length L=152.4 mm, this results in a stain of 0.08778 mm. The offset $CL_{offset}$ may then be calculated as:

$$CL_{offset}=(0.08778\text{ mm})/(152.4\text{ mm})*(958.6\text{ mm})=0.559\text{ mm}$$

This results in a centerline offset $CL_{offset}$ for the strips of approximately 0.559 mm.

In the temperature compensation means 202 according to the invention, the strips are side by side with the necessary centerline offset provided by the shims 222 In the example above, shims 222 that space the center lines of the strips 0.559 mm apart will suffice to produce the necessary variation in curvature, and therefore the necessary change in the length of the effective moment arm 208, of twelve percent (12%). The strips may be thicker or thinner as required by the specific application.

If the strips were bonded together along their length dimension, as is conventional, the strips could only be 0.559 mm thick along the radius of curvature in order to provide the necessary offset. This thickness would limit the amount of mass 206 that could be attached to the link 204 without risking stress failure.

Figure 9:
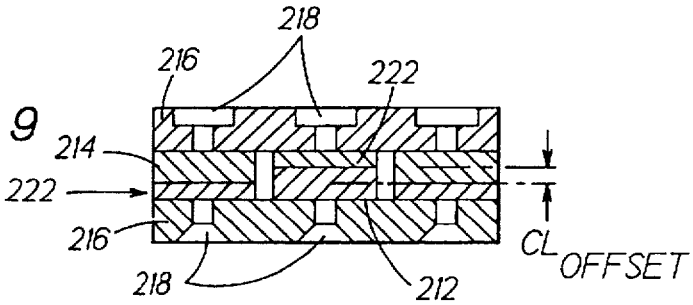
FIG. 9 is a cross-sectional view of the temperature compensating means taken along line 9—9 of FIG. 8.

The device shown in FIGS. 7–9 is one novel example of a temperature compensation means that may be applied to the governor of the present invention. Other means to compensate the operation of the governor for temperature induced fluctuations may also be used, such as using negative resistors (not shown) that are powered by the current flowing through the conductors. Since the current in the conductors is generated by the relative movement of the conductors through the magnetic field, when the governor is at rest the negative resistors are passive devices. Upon sufficient rotation of the governor, the negative resistor increases in resistance with temperature. This type of commercially available resistor, such as a thermistor, may therefore be used to counteract the inverse relationship between resistance of the conductors and temperature.

The present invention has been described and illustrated in FIGS. 1–9 as applied to a specific elevator applications, with references to features that are particularly advantageous to elevator applications. It should be apparent to one skilled in the art, however, that the present invention is not limited to this particular application and is equally applicable to other devices that require a device to regulate the speed of the device.

Although the invention has been shown and described with respect to exemplary embodiments thereof, it should be understood by those skilled in the art that various changes, omissions, and additions may be made thereto, without departing from the spirit and scope of the invention.

What is claimed is:

1. A governor for a moving device, the governor including:

a primary assembly including a element that generates a magnetic field; and a secondary assembly extending through the magnetic field;

wherein one of the primary or secondary assemblies is a stator biased into a first position, wherein the other of the primary or secondary assemblies is a rotor that is rotatable at a rotational speed dependent upon the speed of the moving device, such that if the rotational speed of the rotor exceeds a predetermined speed the stator is moved from the first position.

2. The governor according to claim 1, wherein the element of the primary assembly includes a permanent magnet.

3. The governor according to claim 1, wherein the secondary assembly includes a plurality of conductors disposed on a frame, such that motion of the secondary assembly relative to the magnetic field generated by the primary assembly induces electrical currents in the conductors.

4. The governor according to claim 1, wherein motion of the stator away from the first position actuates a apparatus intended to reduce the speed of the device.

5. The governor according to claim 4, wherein the apparatus for reducing the speed of the device is a switch that disconnects a motive force from the device.

6. The governor according to claim 4, wherein the apparatus for reducing the speed of the device is a brake assembly that applies a braking force to the device.

7. The governor according to claim 1, wherein the primary assembly is the rotor and the secondary assembly is the stator.

8. The governor according to claim 1, wherein motion of the stator away from the first position actuates a apparatus intended to reduce the speed of the device, the apparatus including:

a switch that disconnects a motive force from the device if the rotational speed exceeds a first predetermined speed;

a brake assembly that applies a braking force to the device if the rotational speed exceeds a second predetermined speed greater than the first predetermined speed.

9. The governor according to claim 1, wherein the stator further includes a conductor that is receptive to induced currents generated by the rotor, and wherein during operation of the device the current in the conductor is monitored to determine the functional status of the governor.

10. The governor according to claim 1, further including a stop, and wherein the stator further has a radially unbalanced distribution of mass and includes a mating surface adapted to engage the stop in the first position, such that the radial distribution of mass biases the stator into the first position.

11. The governor according to claim 1, further including a frame having a roller surface, the stator further including an arm extending from the stator, the arm including a roller disposed on the arm in a hinged relationship, the roller engaged with the roller surface to roll on the surface in response to rotation of the stator, and the rotor further including a cam arranged to engage the roller upon sufficient rotation of the stator away from the first position, such engagement between the roller and cam blocking rotation of the rotor.

12. The governor according to claim 1, wherein the moving device is an elevator having a cab movable within a hoistway, and wherein the rotor is rotatable at a rotational speed dependent upon the speed of the cab within the hoistway.

13. The governor according to claim 12, wherein motion of the stator away is from the first position actuates a apparatus intended to reduce the speed of the cab.

14. The governor according to claim 13, wherein the elevator includes drive means for providing motive force to the cab, and wherein the apparatus for reducing the speed of the device is a switch that removes the motive force from the cab.

15. The governor according to claim 13, wherein the elevator includes a brake assembly for applying a braking force to the cab, and wherein the apparatus for reducing the speed of the device actuates the brake assembly.

16. The governor according to claim 12, wherein the elevator includes drive means and a brake assembly, the drive means providing motive force to the cab, the brake assembly applying a braking force to the cab upon actuation, and wherein motion of the stator away from the first position actuates a apparatus intended to reduce the speed of the cab, the apparatus including:

a switch that removes the motive force from the cab if the rotational speed exceeds a first predetermined speed; and an apparatus that actuates the brake assembly if the rotational speed exceeds a second predetermined speed greater than the first predetermined speed.

17. The governor according to claim 1, further including a monitoring system that is responsive to the magnetic field generated by the primary assembly to provide an indication of the strength of the magnetic field generated by the primary assembly.

18. The governor according to claim 17, wherein the monitoring system includes a conductor positioned to be acted upon by the magnetic field generated by the rotor such that a flow of electrical current is generated in the conductor.

19. The governor according to claim 18, wherein the amount of electrical current flowing in the conductor is monitored to provide feedback on the functioning of the governor.

20. The governor according to claim 17, wherein the monitoring system includes a switch having an element responsive to the magnetic field generated by the primary assembly, such that upon failure of the primary assembly to generate a magnetic field of sufficient strength the element is actuated to prevent operation of the moving device.

21. The governor according to claim 1, further including means to compensate the operation of the governor for temperature fluctuations.

22. The governor according to claim 21, wherein the temperature compensation means includes a bimetallic link.

23. The governor according to claim 22, wherein the temperature compensation means further includes a mass attached to the link, and wherein the mass is engaged with one end of the link and the opposite end of the link is attached to the stator.

24. The governor according to claim 21, wherein the link includes a strip of a first material adjacent to a strip of a second material, the strips arranged side by side and with their longitudinal centerlines offset a predetermined distance.

25. The governor according to claim 24, wherein the strips are engaged with shims that are sized to provide the predetermined offset distance.

26. The governor according to claim 21, wherein the temperature compensation means includes a negative resistor engaged with the secondary assembly.

* * * * *